United States Patent [19]

Walsh

[11] 4,246,308

[45] Jan. 20, 1981

[54] CURLED FLOCK FABRIC AND METHOD FOR MAKING SAME

[75] Inventor: David I. Walsh, Barrington, R.I.

[73] Assignee: Microfibres, Inc., Pawtucket, R.I.

[21] Appl. No.: 22,611

[22] Filed: Mar. 21, 1979

Related U.S. Application Data

[63] Continuation of Ser. No. 845,402, Oct. 25, 1977, abandoned, which is a continuation of Ser. No. 685,173, May 11, 1976, abandoned.

[51] Int. Cl.[3] ..... B32B 3/02; B32B 33/00

[52] U.S. Cl. ..... 428/88; 427/200; 427/206; 428/89; 428/90; 428/92; 428/97; 428/371

[58] Field of Search ..... 428/88, 89, 90, 92, 428/97, 371; 427/200, 206

[56] References Cited

U.S. PATENT DOCUMENTS

| | | | |
|---|---|---|---|
| 2,255,779 | 9/1941 | Kent | 428/90 |
| 3,293,105 | 12/1966 | Koller | 428/90 |
| 3,314,845 | 4/1967 | Perri | 427/206 |
| 3,922,410 | 11/1975 | Halloran | 428/90 |

*Primary Examiner*—Marion McCamish
*Attorney, Agent, or Firm*—Miller & Prestia

[57] ABSTRACT

The present invention relates to a method for producing a mixed flock fabric of different filaments in which highly curled filaments are straightened, sized, cut into a length of 0.1 to 0.4 inch and electrostatically flocked with non-sized fibres onto a substrate, so that when the size is removed, there is formed a mixed flock fabric having mixed, stiffened and individual fibres.

21 Claims, 4 Drawing Figures

CURLED FLOCK FABRIC AND METHOD FOR MAKING SAME

This is a continuation of application Ser. No. 845,402 filed Oct. 25, 1977, now abandoned which is a continuation of application Ser. No. 685,173, filed May 11, 1976, now abandoned.

BRIEF DESCRIPTION OF THE INVENTION

This invention relates to a method and apparatus for making a highly crimped or curled flock fabric, and to the product, and also relates to the production of fabrics wherein some of the flock fibres are curled and others are straight.

BRIEF DISCUSSION OF THE PRIOR ART

It is conventional to manufacture flocked fibres by using an electrostatic flocking chamber into which individual flock-cut fibres are fed. These fibres, electrostatically energized, are substantially straight and impinge substantially vertically upon the surface of the substrate, and are held in this position by an adhesive previously applied to such surface. The resulting products, after drying the adhesive, have found considerable utility for a variety of end uses, such as for fabrics, wallpapers, outerwear, etc. Ordinarily in such prior art processes the flocked fibres are straight, individual fibres, and they tend to distribute themselves quite uniformly over the surface of the substrate, each fibre standing straight up substantially vertically from the surface of the substrate and parallel to and equally spaced with respect to the adjacent fibres.

The patent to Kent U.S. Pat. No. 2,255,779 discloses a procedure for flocking pile in which long pile products are produced, such as artificial furs or plushes, although in some cases shorter fibres may also be produced. A special adhesive is applied to the substrate, and the sized pile is then flocked onto the substrate. However, the reference does not suggest the use of electrostatic flocking wherein the fibres are impinged upon the substrate under the influence of a high voltage field. Further, the resulting product does not have kinked or highly curled fibres, since Kent's fibres are substantially straight.

The patent to Truscott et al U.S. Pat. No. 3,585,098 discloses a method of making a fabric having a "bark effect", similar to that appearing on the surface of a tree. However, this is the result of relaxation of the inherent fiber stresses and the disorientation and curling of fibers which produces the effect. In order to accomplish this process, the pile surface of the fabric is softened by the heat of a hot fluid. There is no stretching of curled yarn, followed with the application of a stiffening agent while the yarn is straightened out. There is no step of later removal of the size or other stiffening material.

Similar comments are applicable with respect to the patent to Hatt U.S. Pat. No. 3,900,623. In that patent, the yarn is subjected to a crimping treatment of an asymmetrical or one-sided type, and the carpet is fabricated followed by subjecting the carpet to heat treatment preferably under the influence of moisture. Once again, the patent fails to suggest the idea of using a size solution in order to keep the crimp straightened out, followed by fabricating of any kind and then followed by washing out the size solution.

Further, neither of the cited references discloses the idea of electrostatically flocking with the use of flock particles which have been so treated.

OBJECTS OF THE INVENTION

It is an object of this invention to provide a commercially economical and practical way of making a novel and distinctive curled flock suede from textile yarns.

Still another object of this invention is to provide a method wherein flocking may be utilized to produce a curled flock product, which product has a striking physical and ornamental appearance.

Still another object of this invention is to provide a method for making a curled flock synthetic suede product having excellent surface properties but which requires a smaller amount of flocked fibres on the substrate than straight flocked fabrics. Other objects and advantages of this invention, including the simplicity and economy of the same, and the wide variety of different products that can be made while utilizing its principles, will further become apparent hereinafter and in the drawings.

DRAWINGS

DETAILED DESCRIPTION OF THE INVENTION

Figure 1:
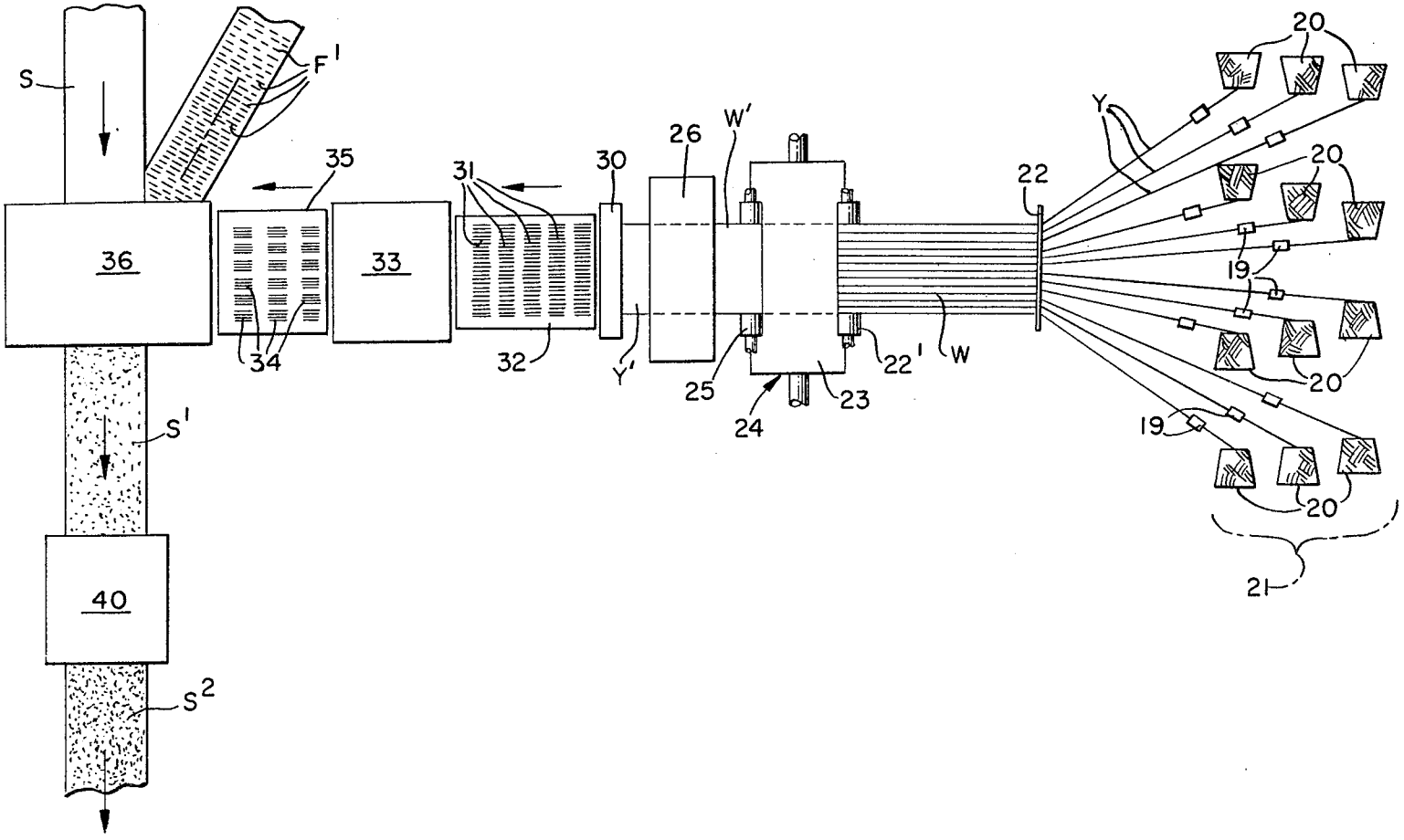
FIG. 1 is a schematic plan view showing a method utilizing features of this invention.

Although this invention will now be described in specific terms, having reference to the particular forms of the invention selected for illustration in the drawings, it will be appreciated that the invention may be practiced in a wide variety of forms, and that the specific terms hereinafter used in this specification are not intended to limit the scope of the invention, which is defined in the appended claims.

The expression, "yarn" means a collection of a number of filaments. Such yarns may have a denier of about 10 to 2,000, for example, but the yarn is preferably a multi-filament yarn.

The yarns to which the invention is applied are stretch synthetic yarns which are subject to heat setting and which, for example, may be produced from synthetic polyamide, polyesters, and the like, such as polyhexamethylene adipamide, polyethylene terephthalate, polycaproamide, and many other polymers useful in the textile industry, including mixtures and structural composites composed of two or more longitudinally extending segments of different polymers. The invention is particularly applicable to heat-setting continuous thermoplastic monofilaments formed from these polymers, and it is also applicable to multi-filament yarns.

It is known in the art to produce a high degree of stretch by applying torque or twist in synthetic yarns. By "torque" or "twist" is meant either a twist along the longitudinal axis of the yarn inserted, for example, by a conventional false twist device, or helical crimp caused by wrapping two (or more) yarns generally spirally around each other. Such processes include heat setting such torqued or twisted yarn to produce yarn having residual torsional forces, i.e., to produce torque-lively yarn.

As used in connection with this invention, the term "yarn" is intended to include an elongated bundle of filaments arranged substantially parallel to each other, having a reasonably uniform thickness along its length. The filaments may either be continuous or discontinuous, the same as each other or a blend of different fibres, of the same or different denier, and may include natural fibres or synthetic fibres alone, or synthetic fibres blended with natural fibres. Although the most frequently used form of yarn is a continuous filament yarn, this invention may be utilized as well with waste yarns, spun yarns, braided or twisted yarns and the like, provided that the aggregation of yarn is spread out in the form of a flat warp or the like, as heretofore disclosed. The yarn, of course, may be of any suitable denier.

The torque stretch yarn utilized in accordance with this invention may be produced, for example, by the conventional "Helanca" method which consists basically of uptwisting to insert a high twist, heat-setting to "set" the twisted structure, and untwisting to remove the yarn twist. The yarn may either be used as such or by plying together single stretch yarns of opposite torque, to give a balanced note-torque yarn which is highly stretchable.

Stretch yarn may also be produced by the high speed continuous false twist process, on stretch yarn machines, wherein the yarn is subjected to twisting, heat-setting, and detwisting in a continuous process.

Stretch yarns suitable for use in connection with this invention include those disclosed in the patent to Kunzle U.S. Pat. No. 2,463,619, Heberlein U.S. Pat. No. 2,463,620, Heberlein U.S. Pat. No. 2,655,781, and Weiss et al U.S. Pat. No. 2,904,952, for example.

Other patents disclosing yarns produced by false twisting include the patents to Stoddard et al U.S. Pat. No. 2,803,105, 2,803,108 and 2,803,109.

Other procedures may be utilized for producing stretch yarn in accordance with this invention, provided such procedures are conducted in a manner to provide sufficient stretch as hereinafter defined. The so-called "Agilon" type of yarn is useful in this connection; it is produced by an edge crimping process of the type described in U.S. Pat. Nos. 3,035,328 and 3,047,932, and in British Pat. No. 722,756 entitled "Improved Process for Crimping Artificial Threads or Filaments".

The so-called "modified" stretch yarns may be utilized. These include false twist type stretch yarns that have been produced on stretch yarn machines using special settings and a rather low number of turns per inch. These yarns have a relatively low stretch, but may be utilized if the stretch is sufficient as defined in further detail hereinafter. This type of modified stretch yarns also includes false twist type stretch yarns that have been generally overfed, up to 30 percent or more, through a second heat zone. They also include the so-called "set" yarns, which are produced by heat-setting or stabilizing soft wound take-up packages of regular false twist type stretch yarn, in a manner to develop the crimp. Such yarns also include the so-called "Agilon" yarn of the developed and stabilized type, produced by over-feeding a normal edge crimped yarn, over a developing and stabilizing heater. Such yarns have good stretch and good recovery from stretch.

Turning now to FIG. 1 of the drawings, the starting material which is utilized in accordance with this invention is a plurality of synthetic multifilament yarns Y, which are conveniently delivered from packages or cones 20. Each yarn consists of a multiplicity of individual filaments which are highly crimped or curled as by false-twist crimping or the like. The so-called "stretch" yarns as heretofore discussed are suitable.

Yarns used in this invention may have a denier ranging from a rather low denier of perhaps 10, more or less, all the way up to a heavy denier yarn, such as a yarn having a denier of 2000 or even more. Further, the denier per filament may vary considerably, but it is preferably a substantially uniform denier per filament throughout the yarn. Typical deniers per filament range from 1 to 5, for example. Similarly, the yarn which is used as the starting material in accordance with this invention may be a continuous synthetic multifilament yarn of any of a wide variety of synthetic materials such as rayon, nylon, acrylic, polyester, etc.

The yarns Y are desirably supplied in a highly crimped form, such that upon relaxing a length of yarn taken from a cone 20, it strongly contracts and curls and winds about itself. Yarn of this kind has an extremely high degree of stretchability, for example, a stretchability from 200% to 1000% or even more.

The yarns Y wound upon the cones 20 are preferably mounted on a creel or the like, schematically shown in FIG. 1 and designated collectively by the number 21. Such creels are well known in the textile art and will not be described in specific detail herein. It should suffice to say that each individual end of yarn from each individual cone 20 is taken from the creel. Upon leaving the cones 20 the normally curly stretch yarns Y are held in a straightened-out condition by the running tension that exists, and are passed through tension devices 19, in order to assure that a tension may be applied to each yarn as it moves downstream from the tension devices 19. The yarns Y are then guided by guides 22 so that the individual ends of yarn are arranged in the form of a warp wherein all of the yarns are under tension and proceed at a common speed, and move along paths which are parallel to and immediately adjacent to each other. The yarns may be arranged so closely as to touch each other or may be slightly spaced apart from one another.

After having been formed into a warp, the yarns Y are then passed over a feed roll 22' and under an immersion roll 23 in a size box 24. The yarns, which are stretched out straight by the tension applied by the feed roll 22', become saturated with a liquid size solution, which may be starch, carboxymethyl cellulose, or any of a wide variety of other well known water-soluble sizes. The warp W then continuously emerges from the size box 24, passing over the exit roll 25, producing a sized warp W' which is then conducted through the dryer 26 in order to dry the size in a manner to adhere the size to all of the stretched-out filaments in the warp. The presence of the size prevents the previously curled or crimped filaments from reverting to their initial curled or crimped configurations.

The number 30 designates a guillotine-type flock cutter which has a knife edge which reciprocates up and down at a rapid rate, continuously chopping the advancing solidified sized yarns Y' into a plurality of individual cut flock-length fibres. Each of these individual cut fibres is maintained during and after the flock cutting operation in a straightened out and stiffened condition by the dried size.

The individual flock fibres are collected and are passed continuously on a conveyor belt 32 to a mill 33, in which the stiff fibres 31 are gently beaten or rubbed together in order to separate them from each other in preparation for electrostatic flocking.

The stiffened fibres are conducted on the conveyor belt 35 to an electrostatic flocking chamber 36. A substrate S, which may be a fabric or a flexible sheet of almost any kind, carrying on one or more of its surfaces an adhesive coating, is also fed continuously into the chamber 36. As the substrate passes through the electrostatic flocking chamber 36, the stiffened flock fibres 34 are subjected to the influence of the electrostatic field and are impinged substantially perpendicularly upon the surface or surfaces of the substrate S, forming a flocked fabric.

The flocked fabric S′ is then passed through a warm water wash tank 40, in a manner to wash out the size previously applied, to produce the curled flock products $S^2$. With the removal of the size from the stiffened flock fibres, they strongly tend to revert to their initial curled configurations. Thus, after having been flocked on the substrate in substantially straightened-out condition, each of the individual fibers reverts to a markedly crimped or curled configuration after the size has been removed therefrom.

The details of construction and operation of the electrostatic flocking chamber are not shown, since a wide variety of different electrostatic flocking chambers may be used. However, the patent to Walsh U.S. Pat. No. 3,678,894 and the patent to Hawkins U.S. Pat. No. 3,426,729 are representative of typical electrostatic flocking chambers suitable for the practice of this invention.

It will be noted in FIG. 1 that standard flock fibres may also be optionally introduced into the electrostatic flocking chamber, concurrently with the stiffened fibres 34. The standard flock fibres F′ become uniformly distributed with respect to the stiffened flock fibres 34, within the electrostatic flocking chamber, and are substantially uniformly deposited upon the substrate S, in a manner to provide a product having mixed stiffened and individual flock fibres. The standard flock fibres may be of the same or different chemical composition, as compared to the stiffened flock fibres, so that in subsequent piece dyeing, for example, two or more harmonizing or contrasting colors may be obtained.

Figure 2:
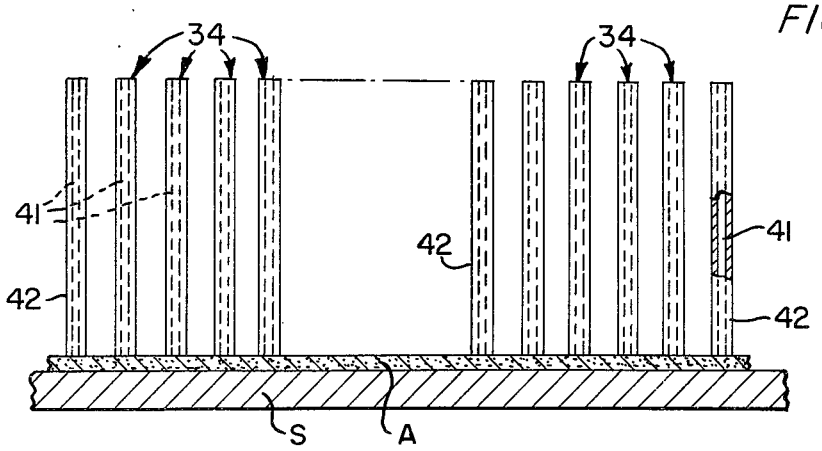
FIG. 2 is an enlarged sectional view of an electrostatically flocked fabric produced at an intermediate stage of the process of production.

FIG. 2 shows a typical flocked product in accordance with this invention, having a substrate S and an adhesive layer A, together with stiffened fibres 34 composed of a multiplicity of previously curl-crimped fibres 41 having adhered size layers 42, each individually adhered to the adhesive A. It will be apparent from FIG. 2 that the fibres 34 are spaced from one another uniformly on the substrate. The influence of the electrostatic field within the chamber 36 tends to space the extended and stiffened fibres substantially uniformly from each other so that they are deposited in the manner appearing in FIG. 2.

Figure 3:
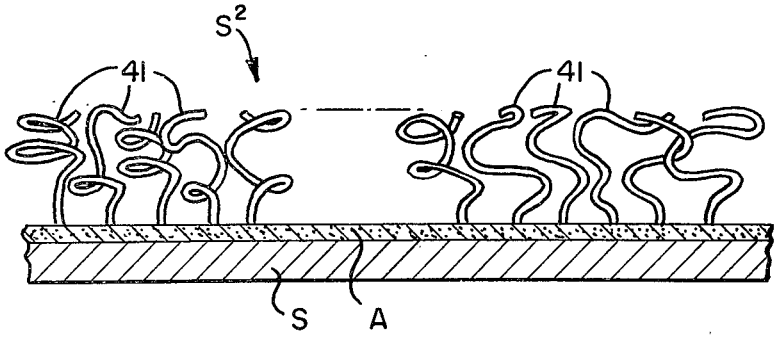
FIG. 3 is a view similar to FIG. 2, showing the same splinter-flocked fabric in a subsequent stage of its production.

FIG. 3 shows the flocked products $S^2$, which is achieved by applying a warm water wash to remove the size from the flocked fabric appearing in FIG. 2. The fibres 41 tend to curl tightly, with or without intertangling. In this manner, a tightly packed curled flock is provided, having a multiplicity of uniformly arranged curly flock fibres.

Excellent coverage is obtained with the use of a minimum weight of flocked fibres. If all of the flock were composed of straight fibres uniformly deposited on the substrate, it would not be possible to provide a product of such high flock density. This feature of the invention is highly advantageous, not only in saving cost but also in providing a fabric or material of superior handling quality.

Figure 4:
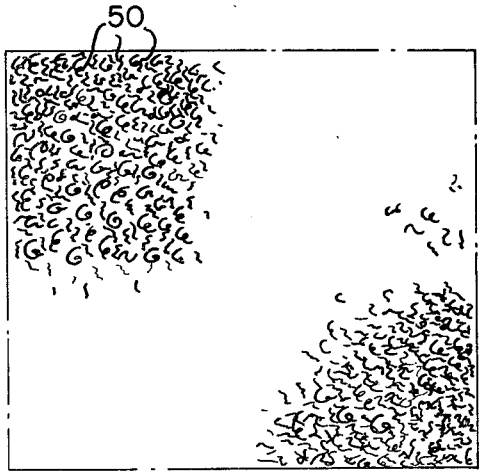
FIG. 4 is a face view of a curled flock fabric in accordance with this invention.

FIG. 4 shows a typical product obtained by electrostatic flocking according to this invention. The individual curled flocked fibres 50 are substantially equally spaced with respect to each other. They tend to curl and to fan out upwardly away from each other. This produces a highly desirable appearance in the final product—one remarkably similar to natural suede which, because of the particular nature of the manner in which an animal grows, contains a wide variety of substantial irregularities with respect to the growth of the nap, resulting in small irregularities, bristles, tufts, etc. This effect is particularly enhanced by providing the curled flock fibres in a longer fibre length than the individual fibres of the prior art.

It will be appreciated that a wide variety of different products having different effects may be obtained. One of the outstanding products is a strikingly life-like synthetic suede product, having curled bristles remarkably resembling those of natural suede.

It will also be appreciated that the flock fibres need not necessarily all be of the same size or denier. Indeed, there may be a random distribution.

It is essentially impossible in actual practice to obtain any such product by using a tow as a starting material, because the yarns must be individually false-twist crimped, and for that reason it is a highly important and critical feature of this invention to begin the process with a warp having a very substantial number of yarns each of which has a substantial number of filaments, which warp is spread out, and which is cut into flock size filaments while in the form of a spread-out warp.

It will be appreciated that different materials may be utilized in combination with each other in accordance with this invention. For example, nylon and rayon yarns may be combined with each other, and then co-flocked, followed by removal of the size. Further, this may be accomplished with any other combination of two or more different fibres.

The operation of the electrostatic flocking chamber is surprisingly efficient in handling the stiffened, size-impregnated flock-length fibres, and in uniformly flocking the individual fibres. Either AC or DC flocking may be used, but particularly when the yarn denier is relatively high, it is sometimes preferable to use an increased voltage in the electrostatic flocking chamber.

This invention has a further advantage in that some of the very light denier-per-filament fibres are different or impossible to flock in a standard electrostatic flocking chamber. For example, $2\frac{1}{2}$ denier per filament flock fibres beyond a length of about 0.050″ to 0.060″ tend to kink, curl, and twist in the course of the electrostatic flocking operation. By way of contrast, it has been discovered that stiffened yarns of 2.5 denier per filament rayon can be processed up to 0.400″ without curl or poor sifting qualities during the flocking operation.

Fibres having a denier per fibre of about 30 to 450 and fibre lengths of 0.1 to 0.4 inch may be preferred.

Still another advantage in accordance with this invention is that the product, such as that shown in FIG. 3 for example, has a substrate S which has a rather large area that is unoccupied by any flock fibres. This is in contrast to a standard flocked substrate, in which the individual fibres are rather tightly distributed over the entire surface of the substrate. Because of the high covering power of the highly curled flocks between the bases of the individual flocked yarns in accordance with this invention, the base fabric is far more flexible and produces a better product having better flock cover.

Although this invention has been described with reference to specific embodiments thereof, it will be appreciated that various other modifications may be made, including the substitution of equivalent components or method steps in substitution for those shown and described. Further, the invention comprehends the use of certain features independently of other features, reversals of parts and the substitution of equivalent elements, all of which modification may be made without department from the spirit and scope of the invention as defined in the appended claims.

The following is claimed:

1. A mixed flock fabric comprising:

a substrate;

an adhesive coating on a surface of said substrate;

a plurality of highly curled first flock fibres having a length of 0.1 to 0.4 inch adhering to said substrate, said first fibres being deposited thereon as straightened fibres having a sizing material adhering thereto for maintaining said highly curled first fibres in a straightened condition, said sizing being subsequently removed for recovery of said first fibres in a highly curled configuration; and a plurality of second flock fibres adhering to said substrate, said second fibres being deposited on said substrate free of sizing material, said fibres being substantially equally spaced from each other.

2. The fabric in accordance with claim 1, wherein said first flock fibres are monocomponent fibres.

3. The fabric in accordance with claim 1, wherein said first flock fibres are formed from heatsetting continuous thermoplastic monofilaments.

4. The fabric in accordance with claim 1, wherein said first fibres have a stretchability in the range of 200% to 1000%.

5. The fabric in accordance with claim 1, wherein said first fibres are formed from yarn having a denier in the range of 10 to 2000.

6. The fabric in accordance with claim 1, wherein said first fibres are formed from filaments having deniers in the range of 1 to 5.

7. The fabric in accordance with claim 1, wherein said first fibres substantially perpendicularly impinge the surface of said substrate.

8. The fabric in accordance with claim 1, wherein said stiffened first fibres are of a small denier and greater than 0.060 inch in length.

9. The fabric in accordance with claim 1, wherein said stiffened first fibres are of a small denier and as large as 0.400 inch in length.

10. A mixed flock fabric of different filaments comprising a substrate, a plurality of first flock fibres having a length of 0.1 to 0.4 inch adhered to and upstanding from the surface of said substrate, said first flock fibres being highly torqued or twisted stretch synthetic yarns having a high degree of stretchability, at least the upper portions of said first flock fibres having a highly curled configuration and a plurality of second flock of a different filament from said first flock fibres adhered to and upstanding from the surface of said substrate, substantially the entire surface of said substrate having first and second flock fibres adhered thereto.

11. The fabric defined in claim 10, wherein straight flock fibres are mingled with said curled flock fibres.

12. In a method of making a highly mixed flock fabric of different filaments, the steps which comprise:

(a) arranging a plurality of highly curled filament yarns having a high degree of stretchability in the form of a warp with a multiplicity of said yarns arranged parallel to each other;

(b) applying to said yarns a tension sufficient to straighten said highly curled filaments;

(c) applying to said yarns, while tensioned under said sufficient tension and while thus straightened, a size material having capacity to maintain said filaments in a straightened condition, drying said size material while said yarns remain in a straightened condition;

(d) cutting the straightened yarns into a first flock of fibre having lengths of 0.1 to 0.4 inch while said size material remains adhered to said filaments to form stiffened flock fibres;

(e) electrostatically flocking said stiffened first flock fibres on a substrate so as to be impinged substantially perpendicularly thereon;

(f) electrostatically introducing a second flock of fibres, said second flock of fibres being free of size material, and (g) removing the temporary size.

13. The method defined in claim 12, wherein the initial yarns are individually combined to form said wide, flat warp, each yarn being kept separate.

14. The method defined in claim 12, wherein said stiffened first flock fibres are electrostatically deposited upon said substrate in combination with a plurality of individual second flock fibres.

15. The method defined in claim 12, wherein said temporary size is a liquid size solution selected from starch or carboxymethylcellulose, and wherein said size is removed by washing with water.

16. The method defined in claim 12, wherein individual second flock fibres are concurrently flocked with said stiffened first fibres.

17. The method of making a fabric in accordance with claim 12, wherein said first flock of fibres are monocomponent fibres.

18. The method of making a fabric in accordance with claim 12, wherein said first flock of fibres have a stretchability in the range of 200% to 1000%.

19. The method of making a fabric in accordance with claim 12, wherein said first flock fibres are formed from filaments having deniers in the range of 1 to 5.

20. The method of making fabrics in accordance with claim 12 further comprising the steps of causing said first and second flock of fibres to substantially perpendicularly impinge the surface of said substrate.

21. The method according to claim 12 wherein the individual second flock fibres are electrostatically flocked on said substrate after the flocking of said first flock fibres.

* * * * *

UNITED STATES PATENT AND TRADEMARK OFFICE

CERTIFICATE OF CORRECTION

PATENT NO. : 4,246,308

DATED : January 20, 1981

INVENTOR(S) : David I. Walsh

It is certified that error appears in the above-identified patent and that said Letters Patent are hereby corrected as shown below:

Column 8, line 8, delete "highly".

Signed and Sealed this

*Second* Day of *June 1981*

[SEAL]

*Attest:*

RENE D. TEGTMEYER

*Attesting Officer*

*Acting Commissioner of Patents and Trademarks*